United States Patent [19]

Hasegawa

[11] 4,332,384

[45] Jun. 1, 1982

[54] WOODEN RACKET FRAME

[75] Inventor: Noriyoshi Hasegawa, Hamamatsu, Japan

[73] Assignee: Nippon Gakki Seizo Kabushiki Kaisha, Japan

[21] Appl. No.: 41,830

[22] Filed: May 23, 1979

[30] Foreign Application Priority Data

| | | | |
|---|---|---|---|
| May 25, 1978 | [JP] | Japan | 53-070625[U] |
| Jun. 13, 1978 | [JP] | Japan | 53-071096 |
| Aug. 23, 1978 | [JP] | Japan | 53-102527 |

[51] Int. Cl.[3] ..... A63B 49/02

[52] U.S. Cl. ..... 273/73 F; 428/106

[58] Field of Search ..... 273/67 R, 67 D, 72 R, 273/73 F, 73 G, 73 C, 73 R, 73 K, 82 R, 167 R, DIG. 3, DIG. 7; 428/54, 106, 188, 113, 114; 124/23 R

[56] References Cited

U.S. PATENT DOCUMENTS

| | | | |
|---|---|---|---|
| 842,411 | 1/1907 | Messinger | 428/106 |
| 1,257,377 | 2/1918 | Miller | 273/82 R |
| 1,367,492 | 2/1921 | Miles | 273/72 R |
| 1,450,646 | 4/1923 | Sadenwater | 273/72 R |
| 1,682,504 | 8/1928 | Hall | 273/73 F |
| 1,687,441 | 10/1928 | Grosjean | 428/54 |
| 1,898,485 | 2/1933 | Hall | 273/73 G |
| 1,949,325 | 2/1934 | Paul | 273/67 D |
| 1,969,842 | 8/1934 | Hall | 273/73 G |
| 2,017,060 | 10/1935 | Hillerich | 273/67 R X |
| 2,023,843 | 12/1935 | Kleinman | 273/73 G |
| 2,132,780 | 10/1938 | Davis | 273/73 F |
| 2,241,080 | 5/1941 | Carpenter | 428/106 |
| 2,305,285 | 12/1942 | Ullrich | 124/23 R |
| 2,878,020 | 3/1959 | Robinson | 273/73 F |
| 3,234,074 | 2/1966 | Bryant | 428/54 |
| 3,390,881 | 7/1968 | Senne | 273/DIG. 3 |
| 3,434,465 | 3/1969 | Stewart | 273/73 F X |
| 3,704,016 | 11/1972 | Berry | 273/82 R |
| 3,949,988 | 4/1976 | Staufer | 273/73 F |
| 3,956,555 | 5/1976 | McKean | 428/106 |
| 3,969,558 | 7/1976 | Sadashige | 428/106 X |
| 3,993,308 | 11/1976 | Jenks | 273/73 F |
| 4,070,019 | 1/1978 | Segal et al. | 273/73 F |
| 4,131,705 | 12/1978 | Kublinsky | 428/106 |
| 4,204,420 | 5/1980 | Rogers et al. | 428/106 X |
| 4,204,421 | 5/1980 | Rogers et al. | 428/106 X |

FOREIGN PATENT DOCUMENTS

| | | | |
|---|---|---|---|
| 103895 | 5/1938 | Australia | 273/73 F |
| 1940524 | 2/1971 | Fed. Rep. of Germany | 273/73 F |
| 244566 | 12/1925 | United Kingdom | 273/73 F |
| 265868 | 2/1927 | United Kingdom | 273/73 F |
| 486159 | 5/1938 | United Kingdom | 428/106 |

*Primary Examiner*—Richard J. Apley

*Attorney, Agent, or Firm*—Ostrolenk, Faber, Gerb & Soffen

[57] ABSTRACT

At least one end surface of a racket frame is occupied by a wooden shell layer obtained by transversely slicing a given elongated wooden material. Transmission of shock on the playing face onto user's hand holding the grip section is well hindered, and development of cracks and generation of wooden burrs are well prevented at drilling of through holes for strings.

22 Claims, 11 Drawing Figures

WOODEN RACKET FRAME

BACKGROUND OF THE INVENTION

The present invention relates to an improved wooden racket frame, and more specifically relates to an improvement in construction of a racket frame made up of a plurality of thin wood layers combined with each other along their side surfaces with their grains all running in the longitudinal direction of the racket frame.

In the oval bow section of the racket frame, the above-described grains run in the peripheral direction of the oval bow section.

Especially when the grain of the outermost thin wood layer runs in the peripheral direction of the racket frame, the layer is provided with enlarged Young's modulus and can afford sufficient mechanical strength to the racket frame on the one hand. On the other hand, however, elastic shock waves caused by hitting balls tend to run through the surface section of the racket frame. Presence of the grain running in the peripheral direction of the oval bow section allows easy transmission of such elastic shock waves through the outermost thin wood layer and the shock on the playing face is easily passed onto the player's hand holding the grip section of the racket frame with little damping during the transmission.

Further, a racket frame is provided with a number of through holes for strings in its oval bow and throat sections. When these through holes are to be drilled, cracks tend to develop in areas surrounding the through holes and wooden burrs are generated around the through holes. Even though such cracks do not seriously degrade maneuverability of the cracked frame, they are easily enlarged after long use due to mechanical shocks imposed on the racket frame, thereby seriously lowering aesthetic value of the racket frame.

Painting is usually applied to the surface of a racket frame in order to enhance aesthetic value of the racket frame. Repeated use of the racket frame, however, causes local falling off of paints from the racket frame surface due, for example, to its accidental impingement upon the ground, thereby seriously lowering aesthetic effect of the coloured racket frame.

SUMMARY OF THE INVENTION

It is one object of the present invention to effectively hinder transmission of shock on the playing face to user's hand holding grip section of the racket frame.

It is another object of the present invention to prevent development of cracks and generation of wooden burrs when through holes for strings are to be drilled in the racket frame.

It is the other object of the present invention to keep aesthetic effect of a racket frame unchanged even after repeated use of the racket frame.

In accordance with the basic aspect of the present invention, at least one wooden shell layer covers at least one end surface of a core block of a racket frame, the shell layer is made up of a plurality of components which are juxtaposed and bonded to each other thickness direction of the shell layer, and the core block is made up of a plurality of thin wood layers which are combined along their side surfaces and provided with grains running in the longitudinal direction of the racket frame. The components may be juxtaposed either in a parallel arrangement or in a lattice arrangement.

DESCRIPTION OF THE PREFERRED EMBODIMENTS

In the following description, surfaces of a racket frame substantially parallel to the playing face of the racket frame are referred to simply as "end surfaces" whereas surfaces substantially normal to the playing face are referred to simply as "side surfaces".

Figure 1:
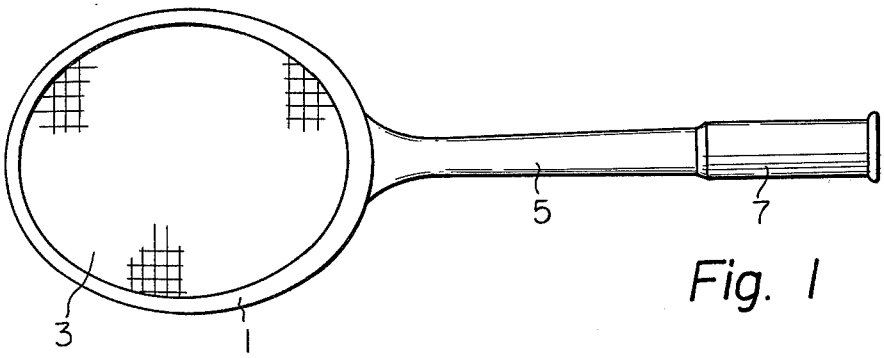
FIG. 1 is a plan view of a tennis racket to which the present invention is advantageously applied.

FIG. 1 depicts the whole construction of a wooden tennis racket frame to which the present invention is advantageously applied. The racket frame comprises an oval bow section 1 defining a playing face 3, a grip section 7 adapted for grip by players' hands, and a shaft section 5 connecting one end of the bow section 1 to the grip section in one body with each other.

Figure 2:
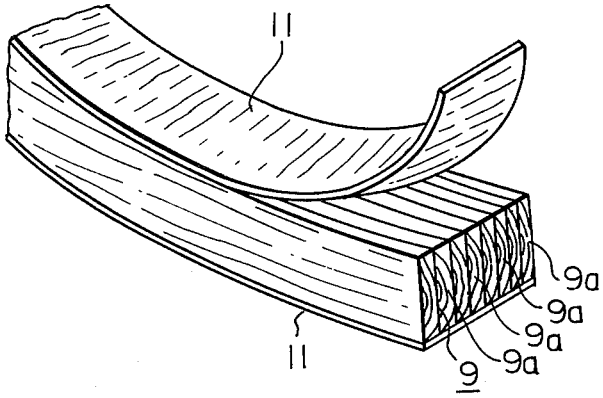
FIG. 2 is a perspective fragmentary view, partly peeled off for better understanding, of one embodiment of the racket frame in accordance with the present invention.

One embodiment of the present invention is shown in FIG. 2, in which the racket frame is made up of a core block 9 and a pair of shell layers 11 bonded to opposite end surfaces of the core block 9. The core block 9 is made up of a plurality of thin wood layers 9*a* combined with each other along their side surfaces with their grains all running in the longitudinal direction of the racket frame, i.e. the peripheral direction, when the invention is applied to the oval bow section 1 of the racket frame. Each shell layer 11 has grains running in the thickness direction thereof.

The shell layer 11 is obtained by cutting a piece of wood transversely. The thickness of the shell layer should preferably be in a range from 0.2 to 2.0 mm., more preferably in a range from 0.5 to 1.0 mm.

The above-described shell layer can be obtained in various ways.

Figure 3A:
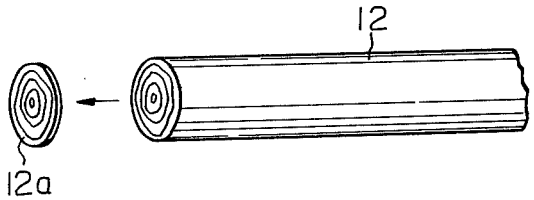
FIGS. 3A to 3C are explanatory perspective views for showing various processes for forming the shell layers used in the racket frame shown in FIG. 2.

In the example shown in FIG. 3A, a natural wood log 12 is sliced transversely into a number of thin plates 12*a* which are then shaped into the shell layers 11 by means of a suitable after-treatment or treatments.

Figure 3B:
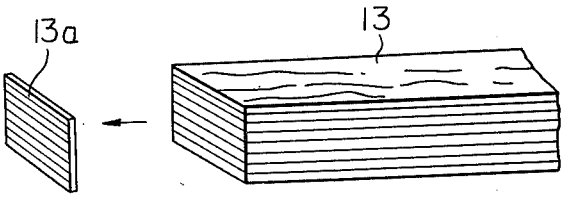

In the example shown in FIG. 3B, an elongated wood block 13 made up of a plurality of superimposed, laminated straight grain plates is sliced transversely into a plurality of thin plates 13*a* which are in turn formed into the shell layers 11 by means of a suitable after-treatment or treatments.

Figure 3C:
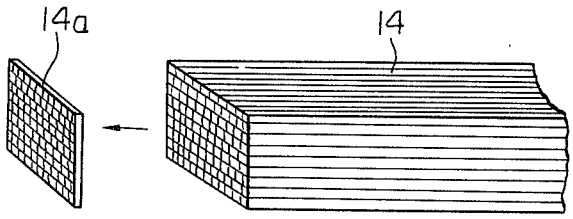

Further in the example shown in FIG. 3C, an elongated wood block 14 made up of a plurality of assembled thin wood sticks bonded together is sliced transversely into a plurality of thin plates 14*a* which are in turn formed into the shell layer 11 by means of like after-treatment or treatments. In this case, the thin sticks are arranged so that their grains run substantially in the longitudinal direction of the wood block 14.

In the above-described embodiment, the shell layers may be arranged, either entirely or partly, on the shaft section 5 of the racket frame also. When the shell layers are to be arranged on the oval bow section, it is advantageous to arrange them on both end surfaces of the racket frame. When the shell layers are to be arranged on the shaft section 5, they may be arranged on the side surfaces, too.

In the construction of the racket frame in accordance with the present invention, at least one shell layer 11 of low Young's modulus is arranged on at least one end surface of the racket frame over the core block 9 of high Young's modulus. Thus, transmission of elastic shock waves through the end surface sections of the racket frame is greatly hindered. In addition, such elastic shock waves go through complicated refraction, interference and dispersion at the border between the core block 9 and the shell layer 11 so that the shock waves are greatly damped. Therefore, transmission of the shock to the player's hand holding the grip section can be greatly minimized without increasing the total weight of the racket frame, thereby assuring ideal maneuverability of the racket frame.

Further, when the shell layers 11 are formed in the manner shown in FIG. 3B or 3C, a fantastic design appears on the end surfaces of the racket frame, which is caused by assembly of cross sections of wood components forming the wood block 13 or 14. Such an aesthetic effect can further be enhanced when the wood components are differently coloured. When each wood component is even internally coloured or dyed, the end surfaces of the racket frame is able to retain its colourful surface design even after abrasion after long use, thereby eliminating the conventional trouble of falling off of paints from the racket frame surface.

Figure 4:
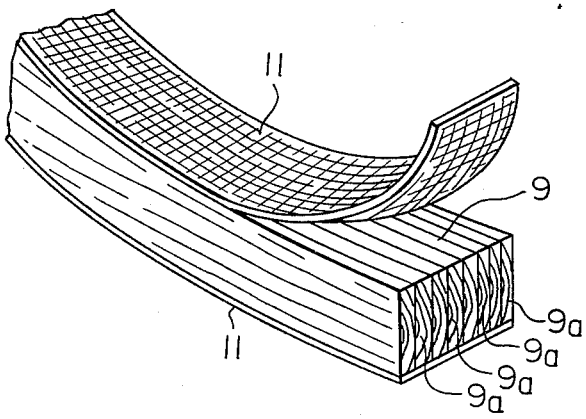
FIG. 4 is a perspective fragmentary view, partly peeled off for better understanding, of another embodiment of the racket frame in accordance with the present invention.

A racket frame including the shell layers 11 obtained by the process shown in FIG. 3C is shown in FIG. 4.

Figure 5:
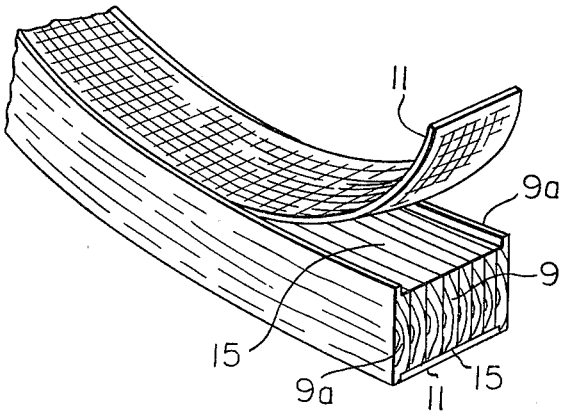
FIGS. 5 to 7 are perspective fragmentary views, partly peeled off for better understanding, of the other embodiments of the racket frame in accordance with the present invention.

FIG. 5 depicts a modification of the racket frame shown in FIG. 4. In this case, the core block 9 is provided, in each end surface, with a center hollow 15 elongated in the longitudinal direction of the racket frame, i.e. the peripheral direction when, the invention is applied to the oval bow section 1 of the racket frame. The width of the shell layer 11 should be designed so that same can be snugly received in the center hollow 15. The center hollow 15 should be wide enough to cover some portions of the corresponding end surfaces of the outermost and innermost thin wood layers 9*a*.

Figure 6:
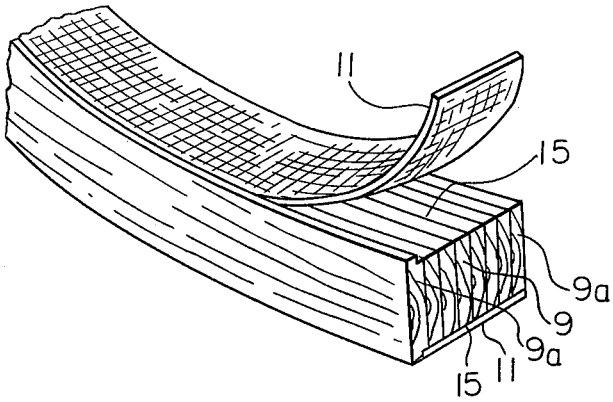

In a further modified embodiment shown in FIG. 6, the hollow 15 may open in one side surface of the racket frame. In this case, the hollow 15 should be wide enough to cover some portion of the corresponding end surface of the outermost or innermost thin wood layer 9*a*.

When the process shown in FIG. 3C is employed for formation of the shell layer 11, each thin wood stick should preferably be provided with a round or polygonal transverse cross section. When the cross section is square or rectangular in shape, the length of each side should preferably be in a range from 0.5 to 3.0 mm. When the cross section is round in shape, the diameter should preferably be in a range from 0.5 to 3.0, also.

In the construction of the racket frame shown in FIGS. 4 to 6, the shell layer 11 is made up of numerous fine wood flakes obtained by transversely slicing the elongated wood block shown in FIG. 3C. The shell layers 11 having the grains of the wood flakes running in the direction normal to the playing face of the racket frame provides the racket frame with enhanced strength against load applied normal to the playing face. In addition, presence of the shell layers 11 of that sort greatly minimizes undesirable change in dimension of the end surfaces to which might be otherwise caused by atmospheric moisture.

Figure 7:
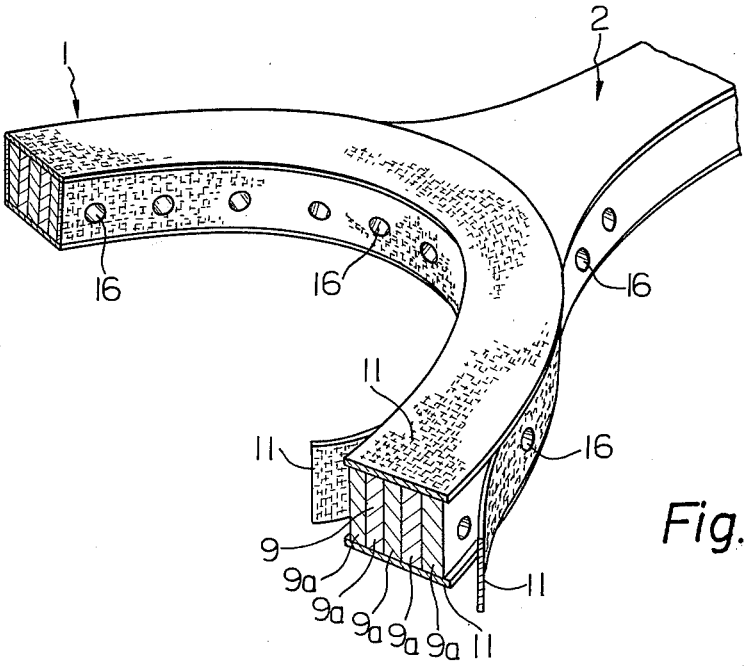

A further modified embodiment of the racket frame in accordance with the present invention is shown in FIG. 7. In this case, the shell layers 11 are arranged not only on the end surfaces but also on the side surfaces of the racket frame at sections where holes for strings are formed through.

More specifically, the oval bow section 1 and the throat section 2 of a racket frame are both provided with many through holes 16 for strings which extend substantially parallel to the playing face of the racket frame. In accordance with the present invention, end surfaces and side surfaces of the core block 9 are covered by shell layers 11, respectively, in sections where the through holes 16 are formed. The shell layers 11 are formed by either of the processes shown in FIGS. 3A to 3C. Although each shell layer 11 wholly covers corresponding surface of the core block 9 with the through holes 16 in the illustrated construction, sufficient effect of the invention can be obtained if the shell layer 11 cover at least the locations of the through holes 16 and their surrounding areas of the surface.

Figure 8:
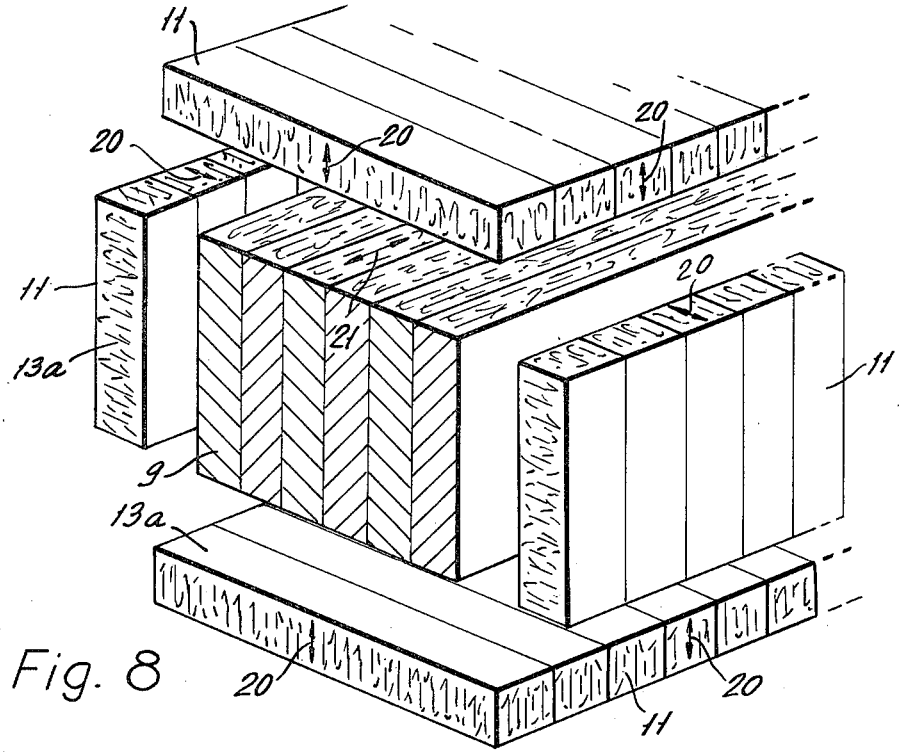
FIG. 8 is an enlarged somewhat exaggerated view of a fragment of the embodiment of FIG. 7 adapted according to the embodiment of FIG. 2.

The embodiment of FIG. 7, adapted according to the embodiment of FIG. 2 can be more clearly seen in FIG. 8 wherein the shell 11 layer is somewhat exaggerated. There is a shell layer 11 according to FIGS. 2 and 3B on both the end surfaces (top and bottom) and the side surfaces (left and right) of the core block 9 in FIG. 8. The shell layers 11 are each comprised of a series of the thin plates 13*a*. In each of the plates 13*a* there is a grain direction illustrated by the arrows 20. Because of the way in which the thin plates 13*a* are cut from the wood block 13, as illustrated in FIG. 3B, it is inherent that the grain direction 20 is always oriented toward and away from the adjacent surface of the core block 9 to which the thin plates 13*a* of the shell layer are affixed, for all of the shell layers 11. The grain direction of the individual wood layers of the core block 9 is illustrated by the arrows 21, i.e. the grain direction runs lengthwise of the racket frame.

Figure 9:
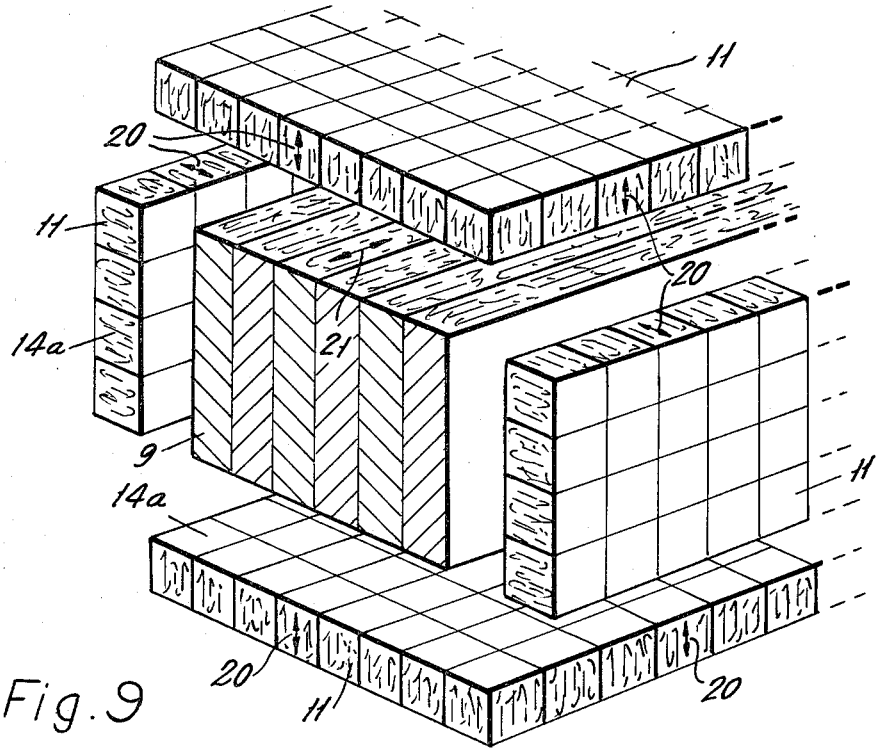
FIG. 9 is an enlarged somewhat exaggerated view of a fragment of the embodiment of FIG. 7 adapted according to the embodiment of FIG. 4.

The embodiment of FIG. 7 modified according to the embodiment of FIG. 3C can be seen in FIG. 9, wherein the shell layer 11 is somewhat exaggerated. The core block 9 with its grain 21 has the same characteristics as in the embodiment of FIG. 8. The shell layers 11 in this embodiment are each comprised of a series of the thin plates 14*a* of FIG. 3C. The individual plates 14*a* are taken from the elongated wood block 14 whose grain direction extends along the longitudinal direction of the block. When the plates 14*a* are cut off from the wood block 14 and are placed along the end and side surfaces of the core block 9, the respective grain direction of the individual flakes or sticks of the assembled thin plates 14*a* are along the direction indicated by the arrows 20. Here also, because of the way in which the thin plates 14*a* are cut from the block 14, as illustrated in FIG. 3C it is inherent that the grain direction of all of the flakes or sticks of the thin plates 14*a* of the shell layers 11 extend into and out of the adjacent surface of the core block 9 to which the thin plates 14*a* of the shell layers are affixed, for all of the shell layers 11.

When drilling is applied to the racket frame of the above-described construction for formation of the through holes, development of cracks and generation of wooden burrs at drilling can be well avoided due to presence of the shell layers.

I claim:

1. An improved wooden racket frame, comprising:

a playing face, an elongated core block extending around said playing face and comprising a plurality of thin wood layers having large side surfaces and which are combined with each other along their large side surfaces and each said wood layer being provided with grains running in the longitudinal direction of said core block, and at least one wooden shell layer affixed to at least one surface of said core block, said shell layer comprising a plurality of distinct laminations which are juxtaposed and bonded to each other and each having grains and the respective grains of said shell layer laminations running in the thickness direction of said shell layer and thereby running toward the said core block surface to which said shell layer is affixed.

2. An improved wooden racket frame as claimed in claim 1, in which said core block has opposite end surfaces parallel to said playing face and two said shell layers each cover a respective end surface of said core block.

3. An improved wooden racket frame as claimed in claim 1, in which said core block has first and second opposite side surfaces normal to said playing face through which through holes for racket strings are formed, said first side surface of said core block being covered by said shell layer in those areas of said first side surface which are adjacent said through holes.

4. An improved wooden racket frame as claimed in claim 3 wherein said at least one shell layer comprises first and second shell layers each covering a respective said side surface of said core block.

5. An improved wooden racket frame as claimed in claim 4 in which said second shell layer covers said second side surface in those areas of said second side surface surrounding said through holes.

6. An improved wooden racket frame as claimed in claim 1 in which the thickness of said shell layer is in a range from 0.2 to 2.0 mm.

7. An improved racket frame as claimed in claim 1 in which each said shell layer comprises a transverse slice of an elongated wood block that is comprised of a plurality of bonded wood sticks.

8. An improved racket frame as claimed in claim 7 in which each said wood stick is polygonal in transverse cross sectional profile.

9. An improved racket frame as claimed in claim 8 in which each said wood stick is square in transverse cross sectional profile.

10. An improved racket frame as claimed in claim 9 in which the length of each side of said square is in a range from 0.5 to 3.0 mm.

11. An improved racket frame as claimed in claim 7 in which each said wood stick is round in transverse cross sectional profile.

12. An improved wooden racket frame as claimed in claim 11 in which the diameter of said wooden stick is in a range from 0.3 to 3.0 mm.

13. An improved wooden racket frame as claimed in any one of claims 1 or 21 in which said shell layer is of a material whose Young's modulus is lower than the Young's modulus of said core block.

14. An improved racket frame as claimed in claim 2, wherein each said shell layer comprises a transverse slice of an elongated wood block that is comprised of a plurality of bonded wooden sticks.

15. An improved wooden frame racket as claimed in claim 2, wherein said core block is so shaped that an elongated center hollow is formed in each said end surface of said core block, and each said shell layer is shaped to be snugly received within said center hollows.

16. An improved racket frame as claimed in claim 4, wherein each said shell layer comprises a transverse slice of an elongated wooden block that is comprised of a plurality of bonded wood sticks.

17. An improved wooden frame racket as claimed in claim 4, wherein said core block is so shaped that an elongated center hollow is formed in each said end surface of said core block, and each said shell layer is shaped to be snugly received within said center hollows.

18. An improved racket frame as claimed in claim 3, wherein each said shell layer comprises a transverse slice of an elongated wood block that is comprised of a plurality of bonded wood sticks.

19. An improved wooden racket frame as claimed in claim 3, wherein said core block is so shaped that an elongated center hollow is formed in each said end surface of said core block, and each said shell layer is shaped to be snugly received within said center hollows.

20. An improved wooden racket frame as claimed in claim 19 in which said center hollow is open in one said side surface of said core block.

21. An improved wooden racket frame comprising:

a playing face, an elongated core block extending around said playing face and comprising a plurality of thin wood layers which are bonded to each other along their side surfaces and provided with grains running in the longitudinal direction of said core block, and at least one wooden shell layer fixed to at least one surface of said core block, said shell layer comprising a number of wooden flakes bonded together at an orientation such that each extends transversely to said surface of said core block and said bonded flakes being arranged in a plane parallel to the one surface of said racket frame, said flakes having grains and the grains of said flakes are all parallel; the grains of said flakes all run in the thickness direction of said shell layer and thereby run toward the said core block surface to which said flakes are fixed.

22. An improved wooden racket frame as claimed in claim 21, in which said shell layer comprises a transverse slice of an elongated wooden block that is comprised of a plurality of bonded thin wood sticks.

* * * * *